US006125914A

United States Patent [19]

Billaud et al.

[11] Patent Number: 6,125,914

[45] **Date of Patent: *Oct. 3, 2000**

[54] METHOD FOR MAKING A COMPOSITE PART WITH MAGNESIUM MATRIX BY INFILTRATION CASTING

[75] Inventors: Laetitia Billaud, Paris; Philippe Le Vacon, Guyancourt, both of France

[73] Assignee: Aerospatiale Societe Nationale Industrielle, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/147,298

[22] PCT Filed: Mar. 23, 1998

[86] PCT No.: PCT/FR98/00579

§ 371 Date: Nov. 23, 1998

§ 102(e) Date: Nov. 23, 1998

[87] PCT Pub. No.: WO98/42463

PCT Pub. Date: Oct. 1, 1998

[30] Foreign Application Priority Data

Mar. 24, 1997 [FR] France ..... 97 03551

[51] Int. Cl.[7] ..... B22D 18/04; B22D 19/14

[52] U.S. Cl. ..... 164/63; 164/61; 164/65; 164/66.1; 164/97; 164/119

[58] Field of Search ..... 164/61, 63, 65, 164/66.1, 97, 119

[56] References Cited

U.S. PATENT DOCUMENTS 5,540,271 7/1996 Cook ..... 164/66.1 X
5,597,032 1/1997 Merrien ..... 164/63 X

*Primary Examiner*—J. Reed Batten, Jr.
*Attorney, Agent, or Firm*—Oblon, Spivak, McClelland, Maier & Neustadt, P.C.

[57] ABSTRACT

A mold having a supply tube in a lower portion and in which has been placed a fibrous preform, is placed in a container. A crucible filled with magnesium blocks is placed under the mold. The magnesium is heated and the mold is preheated under vacuum until the fusion of the magnesium starts. The tube is then introduced into the magnesium and a neutral gas circulation is set up in the container, under a vacuum insufficient to trigger the evaporation of magnesium. After its complete fusion, the magnesium is transferred into the mold by a rapid pressurization of the container. The mold is then cooled and the part removed from the mold.

20 Claims, 2 Drawing Sheets

METHOD FOR MAKING A COMPOSITE PART WITH MAGNESIUM MATRIX BY INFILTRATION CASTING

BACKGROUND OF THE INVENTION

1. Field of the Invention

The invention relates to a process for manufacturing, under pressure casting, parts in a magnesium matrix composite material.

Throughout this document, the term magnesium must be understood as also including all the magnesium based alloys.

On the other hand, the expression "magnesium matrix composite material" includes any material having a reinforcement structure, generally formed of long fibers such as carbon fibers, alumina fibers, etc., sunk into a magnesium matrix. The volume rate of the fibers contained in the material is generally included between about 40% and about 60%.

The process according to the invention can be used advantageously for manufacturing any foundry part requiring both good mechanic characteristics and a reduced mass. Preferential applications of this process can be found notably in the aeronautic and airspace industries.

2. Discussion of the Background

The pressure casting technique (in most cases between about 30 bars and about 100 bars) has been known for manufacturing metallic matrix composite material parts for some years.

According to this technique, are placed in a single hermetic container, comparable to an autoclave, a crucible containing metal blocks designed to form the matrix of the part, and a mold into which has previously been inserted a fiber preform.

During a first step, the insides of the container and of the mold are put under vacuum, the crucible containing the metal blocks is heated and the mold is pre-heated.

When the metal contained in the crucible is entirely molten, it is transferred into the mold. This transfer is executed automatically by pressurizing the container to a defined pressure level, generally comprised between about 30 bars and about 100 bars.

As soon as the mold is full, the cooling of the part is accelerated by bringing a cooling device in contact with one of the mold walls. As long as the temperature has not fallen under the solidification temperature of the metal, the pressure is maintained in the container in order to complete the natural contraction of the metal.

The main known implementation techniques of this process are described in "Pressure Infiltration Casting of Metal Matrix Composites" by Arnold J. Cook and Paul S. Werner in "Materials Science & Engineering" A 144 (October 1991) PP 189–206.

In one of these known techniques, the crucible containing the metal blocks is fixed above the mold, the higher part of which having a receptacle in the bottom of which opens the mold printing of the part to be manufactured. During its fusion, the metal flows into the receptacle through an aperture formed in the bottom of the crucible and initially sealed up. The molten metal is then transferred into the mold printing due to the pressurization of the container. Then, the part is cooled by a cooling plunger brought into contact with the bottom of the mold.

This first technique, wherein the crucible is placed above the mold, has the advantage of enabling the use of a basic and therefore relatively cheap cast. It is thus fairly inexpensive. But, this technique is hardly applicable to the manufacturing of magnesium matrix composite parts, albeit the interest offered by such parts in certain industries, such as the aeronautic and space industries. In fact, the preliminary transfer of the molten metal in the receptacle formed at the upper part of the mold is carried out under vacuum and without any particular precautions. So, the magnesium then risks to evaporate and to deposit itself throughout the installation, causing part of this installation to be non-operative. On the other hand, no precaution has been taken to avoid a magnesium/oxygen explosive reaction, especially when the enclosure is put under pressure.

According to another known technique described in the aforementioned paper of Cook and Werner and in the document EP-A-O 388 235, the crucible containing the metal blocks is fixed under the mold, the lower part of which being equipped with a supply tube, which initially opens above the crucible. The putting under vacuum is done through a vacuum tube that opens directly into the mold. When the metal is molten, the crucible is lifted so that the supply tube of the mold plunges into the molten metal. Thereafter, the transfer of the molten metal into the mold is obtained by pressurizing the container. The cooling of the part is ensured by a cooling block that is brought into contact with the upper wall of the mold.

This technique, in which the crucible is placed under the mold, is more expensive than the preceding one, since the mold must have a supply tube. Conversely, it avoids the intermediary step of transferring the molten metal.

On the other hand, this technique is also non-adapted to the manufacturing of magnesium matrix composite parts. Indeed, the fusion of the metal is entirely carried out under vacuum, as in the preceding technique, so that an evaporation of the magnesium under vacuum is almost inevitable. Furthermore, no special precautions have been taken to avoid a magnesium/oxygen explosive contact.

Moreover, in the document EP-A-O 388 235 as in the part of the above-mentioned paper related to this technique, the putting under vacuum of the container is carried out by a passage under vacuum directly opening into the mold. This results in a further increase of the mold complexity and cost. Furthermore, the liquid metal runs the risk to be sucked by the circuit under vacuum when the mold is filled. Moreover, the presence of this passage under vacuum leads to reduce the thermal exchange surface used to cool the mold during the last phase of the process.

This analysis of the existing techniques for the manufacturing of reinforced metallic parts by pressure casting shows that none of them are adapted for the manufacturing of magnesium matrix parts. Furthermore, no clear adaptation of these techniques to the manufacturing of magnesium matrix parts is suggested in the present state of the art.

SUMMARY OF THE INVENTION

A precise object of the invention is a manufacturing process of a magnesium matrix composite part generally implementing the known techniques of pressure casting, but whose original characteristics enable to suppress any risk of magnesium/oxygen explosive reaction, while avoiding a magnesium evaporation under vacuum.

According to the invention, this result is obtained by means of a manufacturing process of a fiber reinforced magnesium part, characterised in that it comprises the following steps:

insertion of a fibrous preform into a mold equipped with a supply tube projecting downwards;

insertion of the mold above a crucible filled with solid magnesium into a hermetic container;

putting under vacuum of the container and the mold it contains and heating of the magnesium;

as soon as the magnesium temperature approaches a value close to its fusion temperature, implementation of a neutral gas circulation in the container, under an insufficient pressure level to trigger a magnesium evaporation, and introduction of the supply tube into the molten magnesium contained in the crucible;

pressurization of the container under neutral gas atmosphere, so as to transfer the molten magnesium into the mold through the supply tube;

solidification of the magnesium by cooling of the mold;

opening of the container and cast and extraction of the resulting part.

In this process, the pressure increase, as soon as the magnesium starts to melt, enables to avoid its evaporation under vacuum. On the other hand, any risk of oxygen returning inside the container and therefore liable to trigger an explosive magnesium/oxygen reaction, is totally prevented by maintaining the container under a slight depression and simultaneously injecting a neutral gas therein. In fact, a circulation of neutral gas is thus ensured at any given time until the pressurization of the container is achieved.

In a preferred embodiment of the invention, the circulation of neutral gas is set up under a vacuum of about 100 mb.

On the contrary, the heating of the magnesium occurs with an initial putting under pressure of the container and cast at about 0.1 mb.

The circulation of neutral gas preceding the container pressurization is ensured until the magnesium reaches a maximum temperature, for example of about 700° C.

In the preferred embodiment, the neutral gas that is used is argon.

On the other hand, the putting under vacuum of the container and cast is carried out through at least one passage opening directly into the container.

Preferably, the solid magnesium is brought into contact with the supply tube by moving the crucible upwards as soon as the magnesium temperature has reached a lower threshold of its fusion temperature.

On the other hand, the mold is cooled by putting into contact an upper wall thereof and a cooling block placed at the top of the container.

BRIEF DESCRIPTION OF THE DRAWINGS

A preferred embodiment of the process according to the invention will now be described as a non-restrictive example, referring to the appended drawings, in which.

DETAILED DESCRIPTION OF THE PREFERRED EMBODIMENTS

Figure 1D:
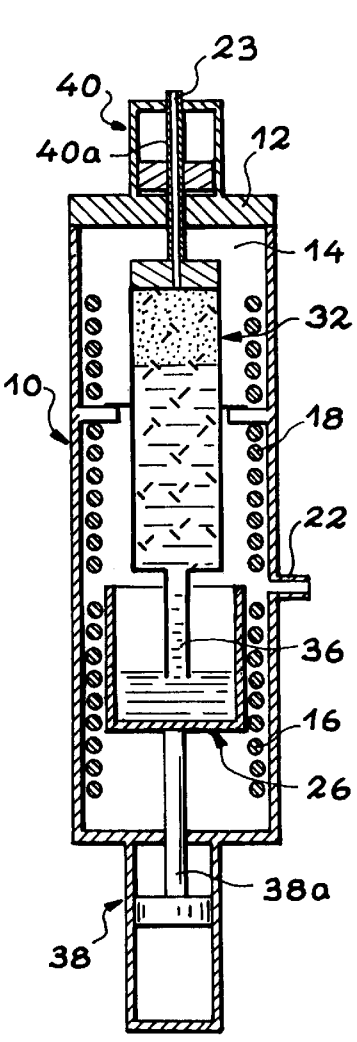
FIGS. 1A–1D are schematic cross-sectional views illustrating the main steps of the process according to the invention.

According to the invention, the installation used for manufacturing a fiber reinforced magnesium composite part by pressure casting presents numerous similarities with the installations usually used for the manufacturing of metallic matrix composite parts. Therefore, a detailed description will be ignored.

As schematically illustrated by FIGS. 1A–1D, the process implementation according to the invention is made in a hermetic container 10 similar to an autoclave. This container 10 is a tubular container centered on a vertical axis. Its upper portion is closed by a lid 12, whose opening allows to access the volume 14 delimited inside the container. When the lid 12 is closed, it sealingly co-operates with the upper edge of the container 10, so as to hermetically close the volume 14.

The container 10 and its lid 12 are designed to support a maximum pressure of about 100 bars in the volume 14.

As schematically illustrated by FIGS. 1A–1D, the container 10 is internally equipped with first heating means 16 placed in the lower portion of the container and second heating means 18 placed in the upper portion of the container. These heating means 16 and 18 can be constituted by any appropriate devices such as electrical resistors. Their implementation is driven and controlled from the outside of the container 10 by a control unit (not shown).

Thermocouples (not shown) are also arranged inside the container 10, to enable the heating regulation ensured by the heating means 16 and 18. A heat insulation (not shown) covers internally all the walls of the container 10, so as to ensure a thermal insulation of the volume 14 with respect to the exterior.

The container 10 is also equipped with several access passages, a single one of which has been schematically shown as numeral 22 in FIGS. 1A–1D. Practically, several passages are generally arranged in the bottom of the container 10 and in the lid 12. As will become clearer in the following description, their main function is to link the closed volume 14 delimited by the container 10 either to a vacuum circuit (not shown), or to a (not shown) source of a neutral gas under pressure, such as argon.

The bottom of the container 10 is equipped internally with a base (not shown) on which may be laid a crucible 26 which initially contains blocks of solid magnesium 28. This crucible 26 is placed inside the first heating means 16.

In its upper portion equipped with the second heating means 18, the container 10 is provided with at least a support 30 on which may be placed a mold 32.

The mold 32 internally comprises one or several cast printings, whose forms and dimensions are identical to those of the part(s) to be manufactured. Each cast printing is filled with a fibrous preform 34 before the mold is inserted into the container 10. The fibrous preforms are generally formed with long carbon, alumina or other fibers designed to form the reinforcements of the part to be manufactured. The volume rate of fibers of the fibrous preform 34 is generally included between about 40% and about 60% of the total volume of the printing.

When the mold 32 is placed in the container 10, the printing(s) it delimitates only communicate(s) with the container internal volume 14 through a single passage, materialized by a supply tube 36. More specifically, the supply tube 36 opens in the bottom of the mold 32 and continues downwards, preferably in accordance with the vertical axis of the container 10. The lower end of the supply tube 36 initially opens at a level close to that of the upper edge of the crucible 26, as shown in FIG. 1A.

Figure 1C:
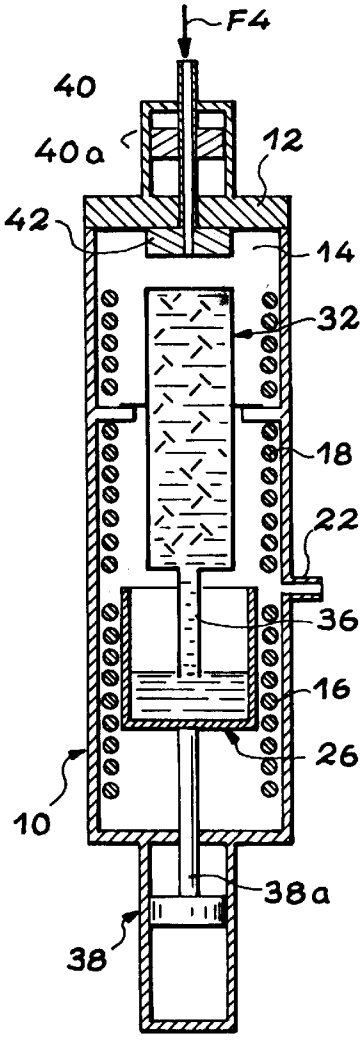
Figure 1B:
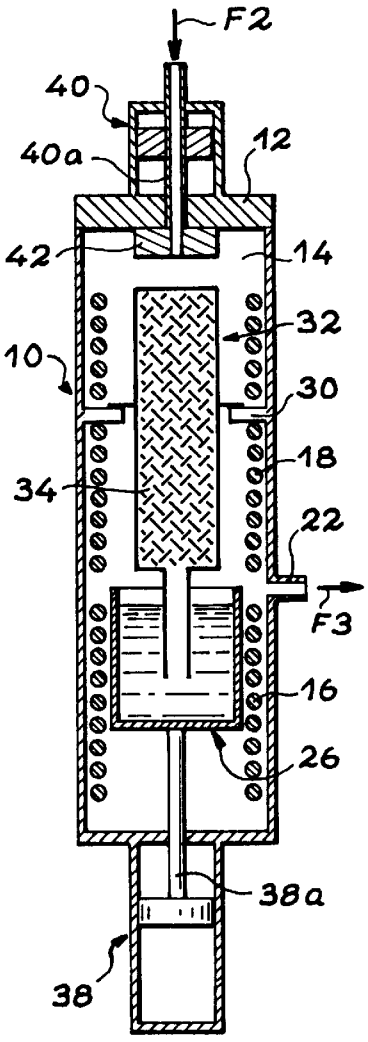
Figure 1A:
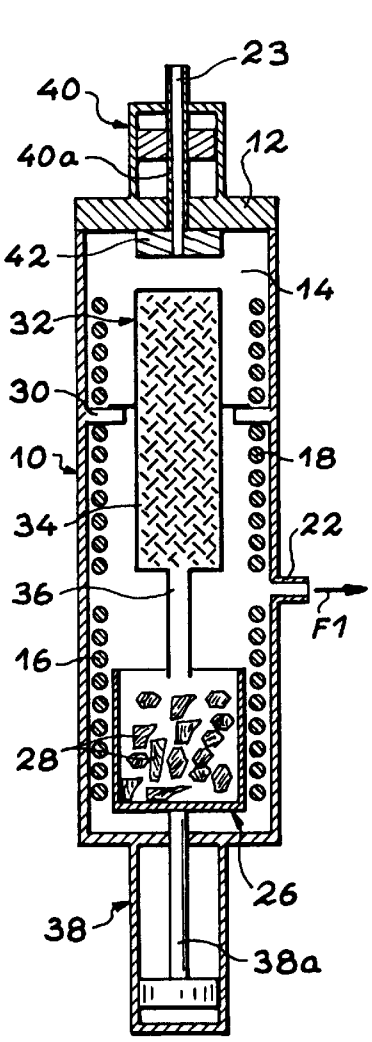

A lower jack 38, initially in lower position as shown in FIG. 1A, is placed under the bottom of the container 10, so that its rod **38*a* sealingly passes through this bottom, in accordance with the vertical axis of the container 10. In the initial lower position of the lower jack 38, the upper end of its rod 38***a* is so situated that the crucible 26 is not lifted from its base.

An upper jack 40, initially in an upper position, is also mounted above the lid 12 of the container 10. The rod 40*a* of this jack 40, which sealingly passes through the lid 12 in accordance with the vertical axis of the container 10, bears at its lower end a cooling block 42. In the initial upper position of the jack 40, this cooling block 42 is moved away from the upper face of the mold 32.

Access passages similar to the passage 22 illustrated by FIGS. 1A–1D can axially pass through the jacks 38 and 40 to open into the volume 14. Thus, a passage 23 passing through the upper jack 40 is illustrated by FIGS. 1A–1D.

FIG. 1A illustrates the initial state of the installation, wherein magnesium blocks 28 in the solid state have been placed into the crucible 26, the mold 32 containing the fibrous preform 34 has been inserted into the container 10 and the lid 12 has been put into place. In this initial state, the lower jack 38 is in lower position and the upper jack 40 is in upper position.

Figure 2:
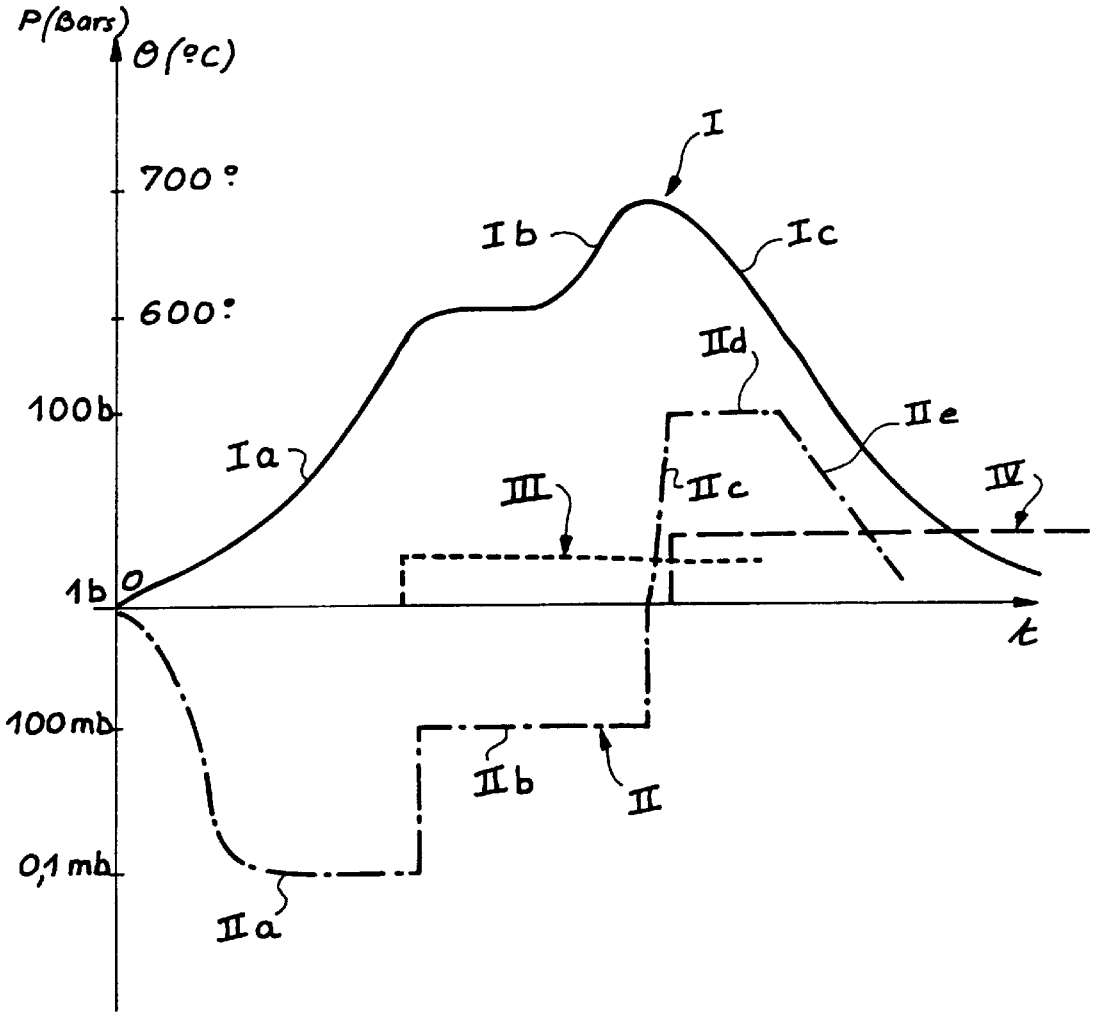
FIG. 2 illustrates respectively in I, II, III and IV, the variation curves, in function of the time t, of the average temperature θ(in ° C.) of the metal, of the pressure P (in bars) found in the container, of the location of the lower jack and of the location of the upper jack.

As shown in portions I*a* and II*a* of the curves I and II in FIG. 2, are then carried out simultaneously and progressively the heating of the magnesium 28 contained in the crucible and the putting under vacuum of the internal volume 14 of the container 10.

More specifically, the heating of the magnesium 28 is ensured by the first heating means 16 and complemented by the preheating of the mold 32 through the second heating means 18. The preheating of the mold 32 aims at avoiding the too rapid solidification of the molten metal when it is subsequently transferred into the mold. The preheating temperature of the mold is thus fairly close to the heating temperature of the magnesium 28 (more or less some dozens of degrees).

On the other hand, the putting under vacuum of the internal volume 14 of the container 10 is ensured by one or several of the access passages which equip the container 10. It is schematically illustrated by the arrow F1 in FIG. 1A, facing the passage 22. The other access passage(s) to the container 10 is (are) then closed by valves (not shown).

As illustrated in the portion II*a* of the curve II in FIG. 2, the vacuum level in the container 10 is stabilized as soon the pressure has reached a level of about 0.1 mb corresponding to a primary vacuum state. This vacuum level is reached long before the starting of the fusion of the magnesium blocks 28 in the crucible 26 that occurs at a temperature of about 600° C. (curve I). This level of temperature is reached after a laps of time depending, among other things, on the quantity of magnesium initially placed in the crucible.

It is to be noted that the putting under vacuum of the internal volume 14 of the container 10 is complemented by a putting under vacuum of the printing(s) formed in the mold 32, since these communicate with the volume 14 through the supply tube 36.

According to the invention, the first step of the process that has just been described with reference to the FIG. 1A, is followed by a step which enables to avoid the immediate evaporation of a portion of the magnesium during its fusion, while eliminating any risk of magnesium/oxygen explosive reaction, and while maintaining a primary vacuum inside the mold 32.

Indeed, if the magnesium fusion was to occur under a primary vacuum, a portion of the magnesium would be evaporated in the installation, and especially in the vacuum circuit, which could result in this installation becoming non-operative for any subsequent use. On the other hand, the vacuum suppression during the magnesium fusion could result in air flowing back to the inside the container 10, which is unacceptable considering the explosive nature of the magnesium/oxygen reaction. Moreover, a primary vacuum must obligatorily be maintained in the mold 32, so as to be certain that the filling thereof is correctly carried out.

According to the invention, these three objectives are reached by setting up a circulation of neutral gas, such as argon, inside the container 10, under a vacuum level insufficient to trigger a magnesium evaporation, as soon as the latter reaches a value close to its fusion temperature.

More specifically, the start of the fusion of the magnesium 28 contained in the crucible 26 is detected and the conditions prevailing in the container 10 are immediately changed, on the one hand, by introducing the lower end of the supply tube 36 into the molten magnesium during fusion and, on the other hand, by setting up a circulation of argon in the volume 14 under a vacuum level of about 100 mb.

The plunging of the supply tube 36 into the magnesium during fusion is obtained by driving the lower jack 38 so as to lift the crucible 26, as shown in FIG. 1B. This enables to eliminate any communication between the internal volume 14 of the container 10 and the printing(s) formed in the mold 32. Therefore, the inside thereof stays under primary vacuum.

Besides, the circulation of argon is set up by injecting argon into the internal volume 14 of the container 10, through one of the access passages, as shown by the arrow F2 (facing the passage 23 formed in the upper jack 40) in FIG. 1B, while maintaining in this volume 14 a controlled vacuum level, by at least another access passage, as shown by the arrow F3 (facing the passage 22). Thus a sweeping of the neutral gas is carried out in the container 10, which avoids any risk of oxygen flowing back towards this container. Nonetheless, the, depression inside the container is insufficient to enable the molten magnesium to evaporate. The quick rise of the pressure up to about 100 mb and the maintaining of the vacuum at this value are illustrated by the portion II*b* of the curve II in FIG. 2.

The start of fusion of the magnesium, which triggers the step illustrated by FIG. 1B, can be advantageously detected by using the lower jack 38. To this end, this jack 38 is driven long before the magnesium temperature reaches 600° C. This driving is illustrated by the curve III in FIG. 2. It results in bringing the lower end of the supply tube 36 to abut against the magnesium blocks 28 contained in the crucible 26. It is progressively lifted as soon as the magnesium fusion starts. A judicially placed sensor simultaneously triggers the argon injection and the pressure increase, as soon as the lifting of the crucible 26 reveals the start of the magnesium fusion. The upper position of the crucible, illustrated by FIG. 1B, can be defined by an abutment or by a sensor (not shown).

As shown in portion Ib of the curve I in FIG. 2, the heating of the magnesium 28 is continued until its fusion in the crucible 26 is completed. So as to ensure this complete fusion and to allow a transfer of magnesium into the mold without risking a premature solidification, its temperature is increased to a predetermined value, for example around 100° C. higher than its fusion temperature. Simultaneously, the circulation of argon under a vacuum level of about 100 mb is maintained.

The laps of time required to obtain this predetermined temperature, for example of about 700° C., varies, depending on the case, between about 30 minutes and about 60 minutes.

When the magnesium temperature reaches this predetermined value, for example about 700° C., the transfer of the molten magnesium 28 from the crucible 26 into the mold 32 by the supply tube 36. This transfer is obtained by pressurizing the internal volume 14 of the container 10, still under a neutral gas atmosphere such as argon. Simultaneously, all the heating means 16 and 18 of container 10 are stopped.

The pressurizing of volume 14 is obtained by interrupting any communication between this volume and the circuit under vacuum and the linking thereof to pressurized argon circuit, as shown by the arrow F4 (facing the passage 23) in FIG. 1C. The pressure is raised quickly, for example about 1 bar/s, until a defined pressure level, generally ranging from about 30 bars to about 100 bars. The rise of pressure to a value of about 100 bars is illustrated in the portion II*c* of the curve II in FIG. 2. This is carried out, for example, in about 1 minute.

The pressurization of the internal volume 14 of the container 10 creates an important difference of pressure between this volume and the inside of the mold 32, still under primary vacuum. Under this difference of pressure, the liquid magnesium is quickly transferred into the mold 32 through the supply tube 36, as illustrated by FIG. 1*c*.

It is to be noted that the velocity of the pressure rise in the internal volume 14 of the container 10 can vary depending on the nature and the disposition of the fibers forming the preform 34. As a matter of fact, this velocity needs to be as high as possible to ensure an efficient filling of the preform fibers, without exceeding a level above which the fibers forming this preform might be displaced or damaged.

As illustrated by the curve IV in FIG. 2, the upper jack 40 is driven to accelerate the cooling of the part, as soon as the pressure in the container 10 reaches the predetermined maximum level (100 bars in the illustrated example). The cooling block 42 is then brought into contact with the upper wall of the mold 32 (FIG. 1D), so that the magnesium begins to solidify starting at the top of the mold.

The cooling effect can be obtained by a cooling circuit (not shown) accommodated in the cooling block 42 as well as by the circulation of a cooling neutral gas, such as argon, injected through the access passage 23 which passes through the upper jack 40. Then this cooling gas circulates between the cooling block 42 and the upper face of the mold 32 in grooves radially formed on the internal face of the cooling block.

The cooling of the magnesium in the mold 32 is illustrated by portion I*c* of the curve I in FIG. 2.

As illustrated by portion II*d* of curve II in FIG. 2, the pressure of about 100 bars is maintained until the magnesium is entirely solidified in the mold 32. Then the pressure in the container 10 progressively decreases, whereas the cooling of the part continues.

When the cooling of the part is completed, the jacks 38 and 40 are brought back to thier initial positions and the lid 12 of the container 10 is opened to enable the extraction of the mold 32. The manufactured part(s) is(are) then removed from the mold.

Of course, the above-described process can support certain modifications without departing from the scope of the invention. Thus, the upper jack 40 can be suppressed. In which case the cooling of the part is obtained by using a lower jack presenting a longer length of stroke. When the cooling is desired to be started, the jack 38 is once again driven to lift the crucible 26 beyond the position illustrated by FIGS. 1B and 1C. The crucible 26 then abuts against the bottom of the mold 32 and lifts it up till its upper face comes into contact with the cooling block 42, which is then directly mounted under the lid 12.

On the other hand, the pressure and temperature levels given by way of example when referring to FIG. 2 can be considerably modified without departing from the scope of the invention. This also applies to the pressure raising velocity during the step illustrated by FIG. 1C.

What is claimed is:

1. A process of making a fiber reinforced magnesium part, comprising the steps of:

inserting a fibrous preform into a mold equipped with a supply tube projecting downward;

inserting the mold above a crucible filled with solid magnesium into a hermetic container;

putting the hermetic container contain the mold and the crucible under vacuum and heating the magnesium in the crucible;

circulating a neutral gas in the hermetic container under a pressure level insufficient to trigger a magnesium evaporation as soon as the temperature of the magnesium approaches a value close to its fusion temperature and inserting the supply tube into the molten magnesium contained in the crucible;

pressurizing the hermetic container under neutral gas atmosphere so as to transfer the molten magnesium into the mold through the supply tube;

solidifying the magnesium by cooling the mold;

opening the hermetic container and the the mold and extracting the resulting fiber reinforced magnesium part.

2. A manufacturing process according to claim 1, wherein the neutral gas circulation is put under a vacuum of about 100 mb.

3. A manufacture process according to claim 1, wherein said heating of the magnesium is associated with putting the hermetic container and the mold under a vacuum of about 0.1 mb.

4. A manufacturing process according to claims 1, wherein said heating of magnesium is continued until it reaches a maximum temperature, thereupon the hemetic container is pressurized.

5. A manufacturing process according to claim 4, wherein said heating of magnesium is continued until it reaches about 700° C.

6. A manufacturing process according to claim 1, wherein the solid magnesium is brought into contact with the supply tube by moving the crucible upwards as soon as the temperature of the magnesium reaches a threshold inferior to its fusion temperature.

7. A manufacturing process according to claim 1, wherein the mold is cooled by setting up a contact between an upper wall thereof and a cooling block placed at the top of the hemetic container.

8. A manufacturing process according to claim 1, wherein the neutral gas that is used is argon.

9. A manufacturing process according to claim 1, wherein the hemetic container and the mold are put under vacuum through at least one passage which directly opens into the container.

10. A manufacturing processing according to claim 2, wherein said heating of the magnesium is associated with putting the hermetic container and the mold under a vacuum of about 0.1 mb.

11. A manufacturing process according to claim 2, wherein said heating of magnesium is continued until it reaches a maximum temperature, thereupon the hemetic container is pressurized.

12. A manufacturing process according to claim 3, wherein said heating of magnesium is continued until it reaches a maximum temperature, thereupon the hemetic container is pressurized.

13. A manufacturing process according to claim 2, wherein the solid magnesium is brought into contact with the supply tube by moving the crucible upwards as soon as the temperature of the magnesium reaches a threshold inferior to its fusion temperature.

14. A manufacturing process according to claim 3, wherein the solid magnesium is brought into contact with the supply tube by moving the crucible upwards as soon as the temperature of the magnesium reaches a threshold inferior to its fuision temperature.

15. A manufacturing process according to claim 4, wherein the solid magnesium is brought into contact with the supply tube by moving the crucible upwards as soon as the temperature of the magnesium reaches a threshold inferior to its fusion temperature.

16. A manufacturing process according to claim 5, wherein the solid magnesium is brought into contact with the supply tube by moving the crucible upwards as soon as the temperature of the magnesium reaches a threshold inferior to its fusion temperature.

17. A manufacturing processing according to claim 2, wherein the mold is cooled by setting up a contact between an upper wall thereof and a cooling block placed at the top of the hemetic container.

18. A manufacturing processing according to claim 3, wherein the mold is cooled by setting up a contact between an upper wall thereof and a cooling block placed at the top of the hemetic container.

19. A manufacturing processing according to claim 4, wherein the mold is cooled by setting up a contact between an upper wall thereof and a cooling block placed at the top of the hemetic container.

20. A manufacturing processing according to claim 5, wherein the mold is cooled by setting up a contact between an upper wall thereof and a cooling block placed at the top of the hemetic container.

* * * * *